US005963996A

United States Patent [19]

Hsia

[11] Patent Number: 5,963,996

[45] Date of Patent: Oct. 12, 1999

[54] SUPPORTING STRUCTURE FOR PLAY YARD

[76] Inventor: Ben Ming Hsia, 27756 Avenue Mentry, Santa Clarita, Calif. 91355

[21] Appl. No.: 09/121,198

[22] Filed: Jul. 22, 1998

[51] Int. Cl.[6] ..... A47D 13/06

[52] U.S. Cl. ..... 5/99.1; 5/98.1; 5/93.1; 256/25

[58] Field of Search ..... 5/99.1, 98.1, 93.1, 5/9.1; 256/25, 24; 119/452, 474; 16/19; 248/188.2, 188.4, 188.8, 677

[56] References Cited

U.S. PATENT DOCUMENTS

| | | | |
|---|---|---|---|
| 2,810,554 | 10/1957 | Blazey | 256/25 |
| 3,268,921 | 8/1966 | Schurle | 5/98.1 |
| 4,008,497 | 2/1977 | Badon | 5/99.1 |

*Primary Examiner*—Michael F. Trettel
*Assistant Examiner*—Fredrick Conley
*Attorney, Agent, or Firm*—David and Raymond; Raymond Y. Chan

[57] ABSTRACT

A supporting structure for play yard includes a top frame, a bottom frame and at least three support posts mounted between the top frame and the bottom frame to define an interior cavity. Each of the support posts includes a frame post having an adjustment base axially affixed to a bottom end of the frame post. Each of the adjustment bases has a threaded upper shank and an enlarged base turner. To assemble the supporting structure, penetrate each of the support posts through a threaded adjusting hole of a respective holding joint of the bottom frame until a top end of the support post rotatably inserts into a head sleeve of the top frame through its bottom opening. Therefore, the distance between the top frame and the bottom frame can be adjusted by screwing the threaded upper shank in or out of the threaded adjusting hole. Thereby, the supporting structure for play yard not only can provide a rigid frame structure free of shaking and rocking, but also can tensely support the cloth boundary to have a better appearance and to reinforce the rigid frame structure to avoid any unwanted collapse.

16 Claims, 4 Drawing Sheets

SUPPORTING STRUCTURE FOR PLAY YARD

FIELD OF THE PRESENT INVENTION

The present invention relates to baby accessories, and more particularly to a supporting structure for play yard which improves the shaking and rocking structure of the foldable play yard and prevents any unwanted folding up after it is set up.

BACKGROUND OF THE PRESENT INVENTION

Play yard is used to restrict the movement of a baby who is able to trail or walk when the parents can not always keep their eyes on their babies. In order to save space for travel and storage, most of the play yards have a foldable design to reduce its size.

Traditional foldable play yard comprises a foldable frame having a plurality of joints pivotally connecting with a plurality of supporting rods to form an open box structure, so that a baby can be put inside a cloth made boundary to restrict his or here movement. Uncountable complains report that babies are likely to be hurt due to the unwanted folding up of the play yards accidentally. Within last year, it is reported that six babies are unfortunately killed by the accidentally folded play yards in this country.

Moreover, any structure that can be folded would not has a rigid structure due to the clearance existing in those foldable joints, so that the conventional foldable play yard has another adverse effect of rocking and shaking. In other words, the conventional play yard fails to provide an absolutely safe environment for the babies.

Since the conventional foldable play yard contains too many joints, it not only unreasonably increases the manufacturing cost thereof, but also provides construction weakness at those joints. Most foldable play yards break at such weakened joint structures that make the products being not durable enough.

It is unreasonable to place your babies in a risky or unsafe situation. However, we have to tolerate the above mentioned suffering drawbacks until an improved innovative play yard structure, that can provide an absolutely safe boundary for the babies and still can reduce its size when it is not used to save the travel or storage space, is developed.

SUMMARY OF THE PRESENT INVENTION

It is thus a first object of the present invention to provide a supporting structure for play yard which can provide an absolutely safe play yard structure for the babies but still can be quickly collapsed to reduce its size when it is not used to save the travel or storage space.

A further object of the present invention is to provide a supporting structure for play yard that is easy to set up and collapse within a relatively short time.

Yet another object of the present invention is to provide a supporting structure for play yard which not only can provide a rigid frame structure free of shaking and rocking, but also can tensely support the cloth boundary to have a better appearance and to reinforce the rigid frame structure to avoid any unwanted collapse.

Still another object of the present invention is to provide a supporting structure for play yard, which has a more simple structure and a more economic cost in comparison with the conventional foldable play yard.

In order to accomplish the above objects, the present invention provides a supporting structure for play yard which comprises a top frame, a bottom frame and at least three identical support posts mounted between the top frame and the bottom frame to define an interior cavity.

The top frame comprises at least three head joints and three top construction posts having equal length. Each of the head joints comprises two connecting ends and a tubular head sleeve integrally connecting between the two connecting ends and having a bottom opening. Each of the top construction posts is connected between two of the head joints by respectively connecting two ends of the top construction post to the respective connecting ends of the two head joints, so as to construct a ring shaped frame.

The bottom frame comprises at least three holding joints and three bottom construction posts having equal length. Each of the holding joints has an axial threaded adjusting hole and two connector ends integrally extended from two sides thereof. Each of the bottom construction posts is connected between two of the holding joints by respectively connecting two ends of the bottom construction post to the respective connector ends of the two holding joints, so as to construct a ring shaped frame.

Each of the support posts comprises a frame post having a predetermined length and an adjustment base axially affixed to a bottom end of the frame post. Each of the adjustment bases has a threaded upper shank and an enlarged base turner, wherein each of the threaded upper shanks has an outer diameter equal to an inner diameter of the threaded adjusting hole of each of the holding joints. To assemble the supporting structure, penetrate each of the support posts through the threaded adjusting hole of the respective holding joint until a top end of the support post rotatably inserts into the head sleeve through its bottom opening. Then, rotate the base turner so as to rotate the threaded upper shank of each of the support posts into the threaded adjusting hole. Therefore, the distance between the top frame and the bottom frame can be adjusted by screwing the threaded upper shank in or out of the threaded adjusting hole.

A boundary shelter is mounted between the top frame and the bottom frame and a bottom panel is mounted on the bottom frame, wherein the boundary shelter holds the top frame, the bottom frame and the support posts together. To gradually increase the distance between the top frame and the bottom frame by rotating the support post tenses the boundary shelter can firmly hold the head sleeves and the top ends of the frame posts together and form the play yard.

To disassemble the play yard, simply unscrew the threaded adjustment shanks from the holding bases and pull out all the support posts. Then, the top frame and the bottom frame can be collapsed to reduce its size for travel and storage.

DETAILED DESCRIPTION OF THE PREFERRED EMBODIMENT

Figure 1:
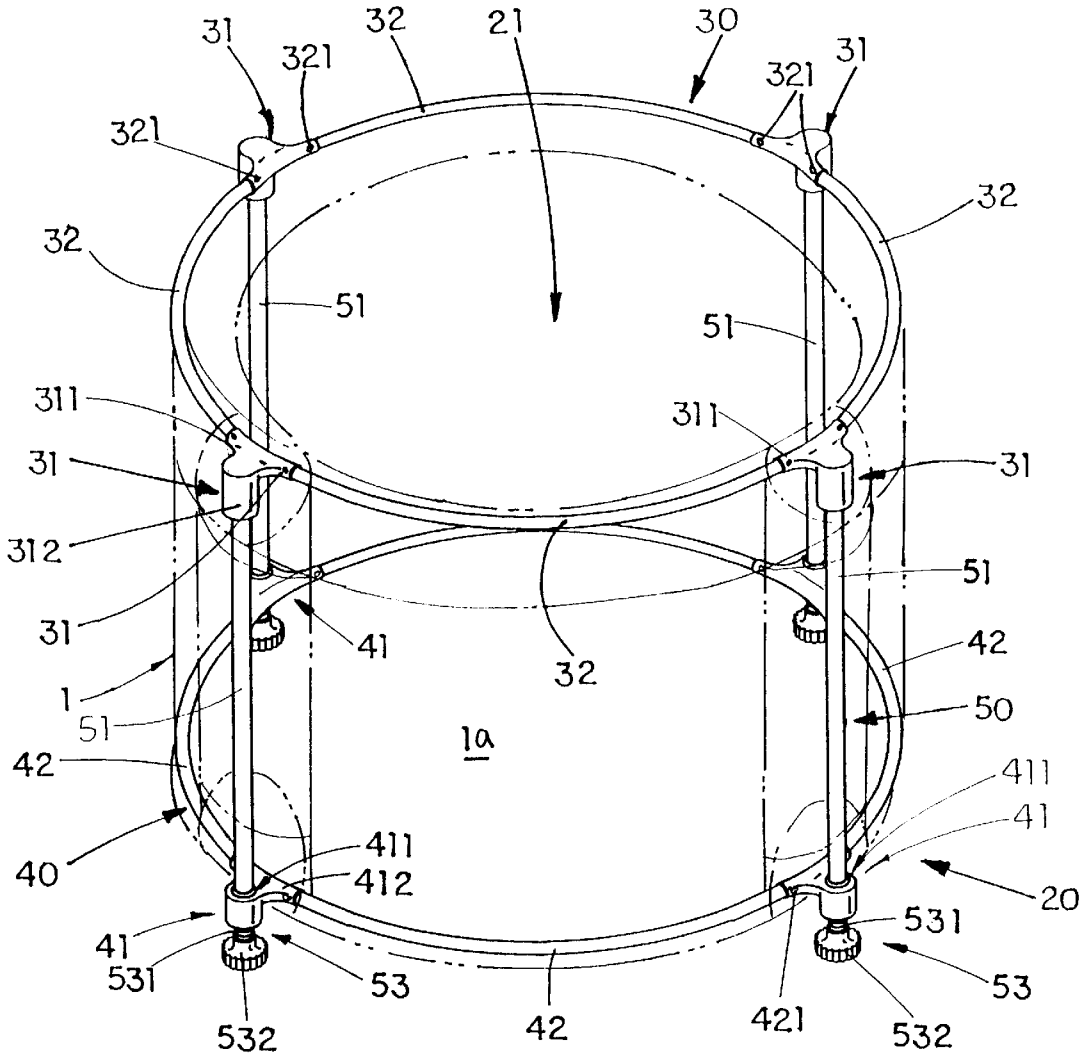
FIG. 1 is a perspective view of a supporting structure of a play yard according to a preferred embodiment of the present invention.
Figure 2:
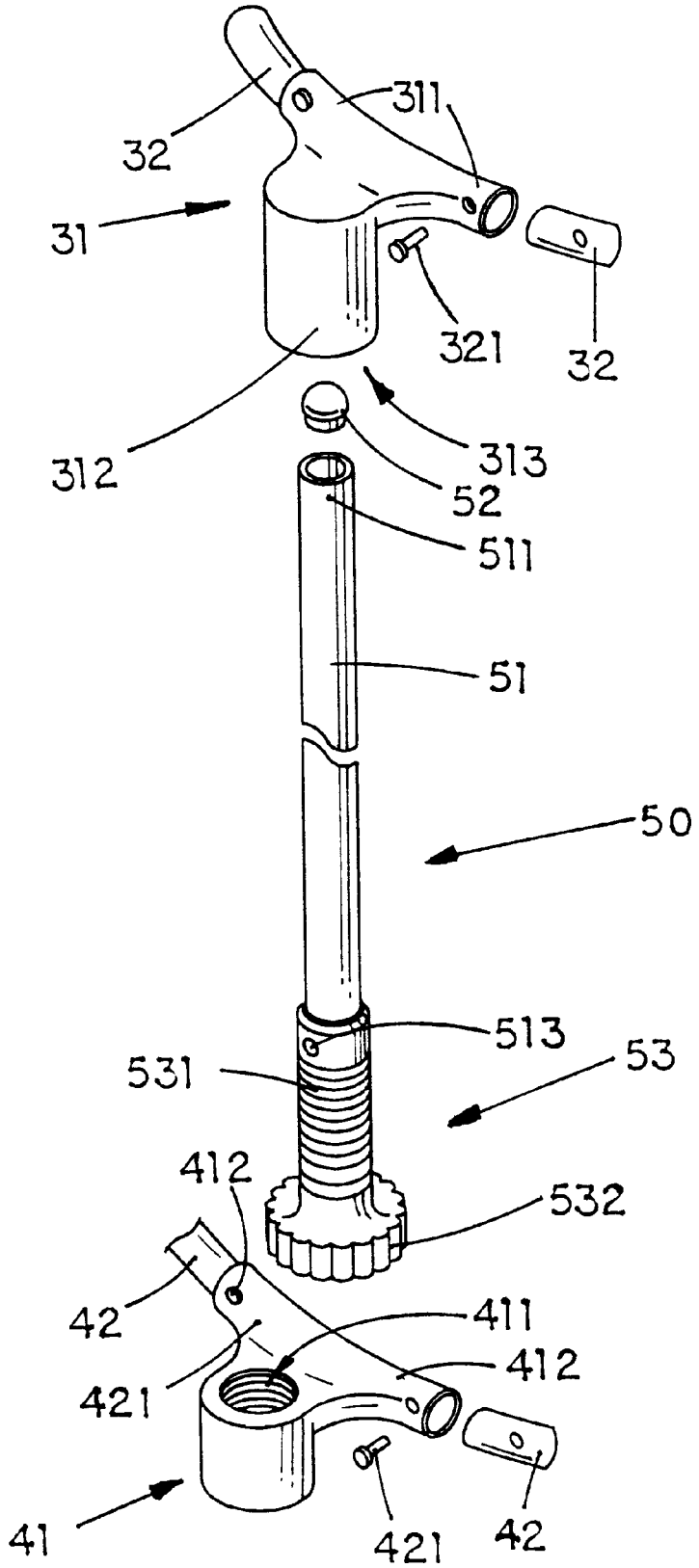
FIG. 2 is an exploded perspective view of a head joint, a support post and a holding base of the supporting structure according to the above preferred embodiment.
Figure 3:
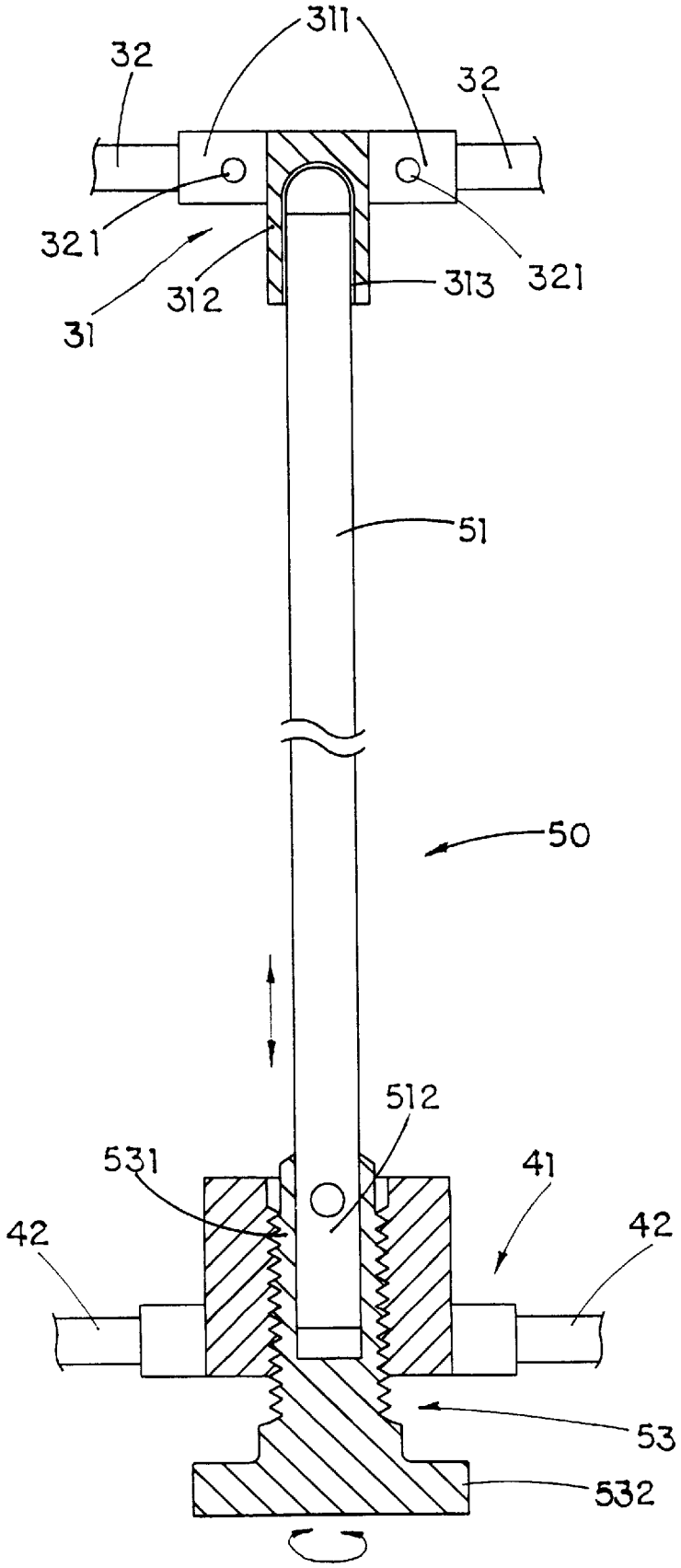
FIG. 3 is a partial sectional view of the supporting structure according to the above preferred embodiment.

Referring FIGS. 1 to 3, a supporting structure 20 adapted to construct with a boundary shelter 1 to form a play yard of the present invention is illustrated. The supporting structure 20 for the play yard comprises a top frame 30, a bottom frame 40 and at least three identical support posts 50 (preferable four support posts provided for rectangular or round shape play yard as shown in FIG. 2) mounted between the top frame 30 and the bottom frame 40 to define an interior cavity 21.

The top frame 30 comprises at least three head joints 31 and three top construction posts 32 having equal length. According to the present embodiment as shown in the drawings, there are four head joints 31 and four top construction posts 32 to construct a circular ring shaped structure. Each of the head joints 31 comprises two connecting ends 311 and a tubular head sleeve 312 integrally connecting between the two connecting ends 311 and having a bottom opening 313. Each of the top construction posts 32 is connected between two of the head joints 31 by respectively connecting two ends of each of the top construction posts 32 to the respective connecting ends 311 of the respective two head joints 31, so as to construct the ring shaped frame. The four top construction posts 32 can be integrally connected with the four head joints 31 by rivets 321 respectively, as shown in FIGS. 2 to 4, or detachably connected to the four head joints 31 by screwing.

The bottom frame 40 comprises at least three holding joints 41 and three bottom construction posts 42 having equal length. According to the present embodiment as shown in the drawings, there are four holding joints 41 and four bottom construction posts 42 to construct a circular ring shaped structure. Each of the holding joints 41 has an axial threaded adjusting hole 411 and two connector ends 412 integrally and oppositely extended therefrom. Each of the bottom construction posts 42 is connected between two of the holding joints 41 by respectively connecting two ends of the bottom construction post 42 to the respective connector ends 412 of the two holding joints 41, so as to construct a ring shaped frame. The four bottom construction posts 42 can be integrally connected with the four holding joints 41 by rivets 421 respectively, as shown in FIGS. 2 to 4, or detachably connected to the four holding joints 31 by screwing.

Figure 4:
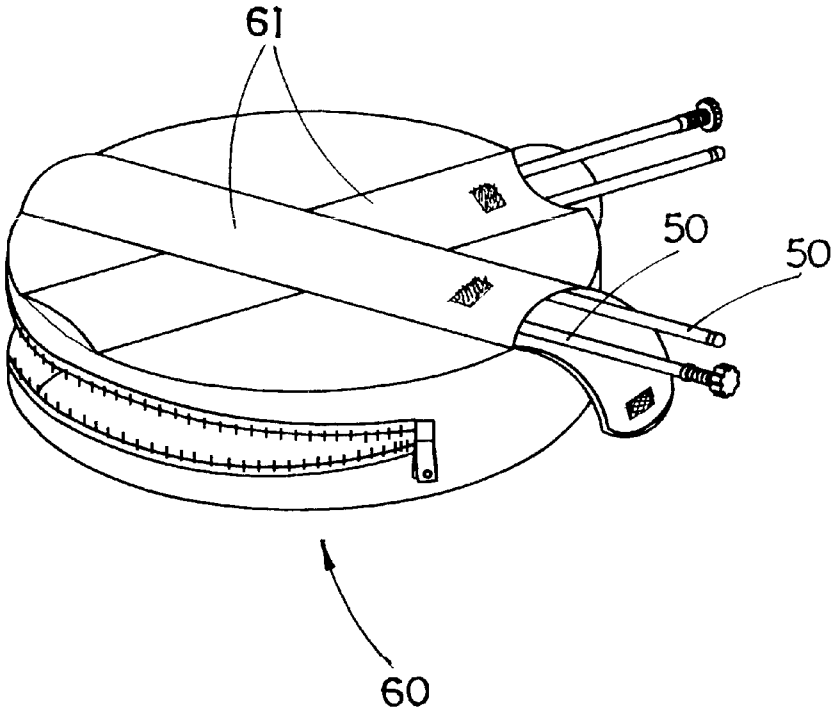
FIG. 4 is a perspective of a collapse supporting structure adapted for storing in a storage pouch according to the above preferred embodiment.
Figure 4:
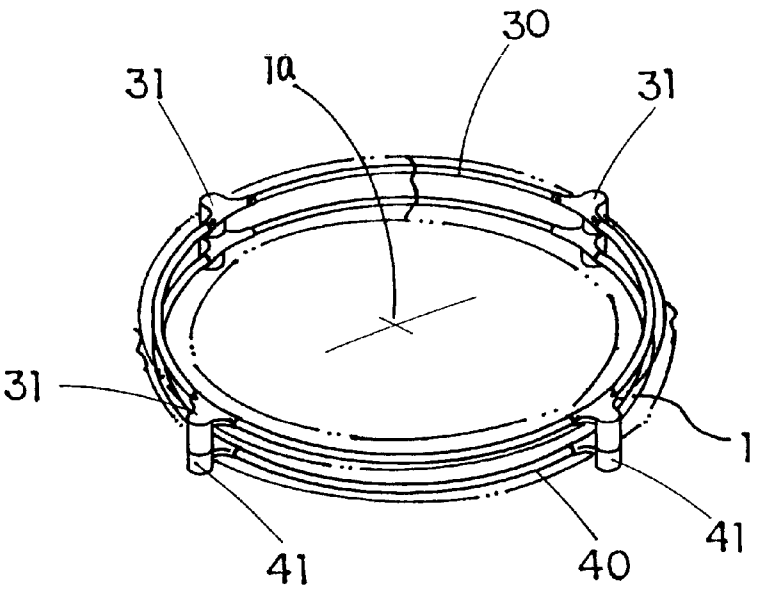

As shown in FIGS. 2 and 3, each of the support posts 50 comprises a tubular frame post 51 having a predetermined length, a top cap 52 is plugged at a top end 511 of the frame post 51, and an adjustment base 53 axially affixed to a bottom end 512 of the frame post 51, wherein the bottom end 512 is axially inserted into the adjustment base 53 and secured by rivets 513 (as shown in FIG. 4). Each of the adjustment bases 53 has a threaded upper shank 531 and an enlarged base turner 532 adapted for more steadily sitting on ground to support the supporting structure 20 of the present invention and facilitating the user to grip thereon for rotating the support post 50, wherein each of the threaded upper shanks 531 has an outer diameter equal to an inner diameter of the threaded adjusting hole 411 of each of the holding joints 41.

To assemble the supporting structure 20, as shown in FIGS. 1 and 3, penetrate each of the support posts 41 through the respective threaded adjusting hole 411 of the respective holding joint 41 until the top end 511 frame post 51 as well as the top cap 52 of the support post 50 rotatably inserts into the head sleeve 312 through its bottom opening 313, wherein the top cap 52 can reduce the friction between the top end 511 of the frame post 51 and the head sleeve 312 so as to enable the top end 511 of the frame post 51 smoothly rotating in the head sleeve 312. Then, rotate the base turner 532 so as to rotate the threaded upper shank 531 of each of the support posts 50 to engage in the respective threaded adjusting hole 411. Therefore, as shown in FIG. 4, the distance between the top frame 30 and the bottom frame 40 can be adjusted by screwing the threaded upper shank 531 in or out of the threaded adjusting hole 411.

The boundary shelter 1 is mounted between the top frame 30 and the bottom frame 40 and a bottom panel 1*a* is mounted on the bottom frame 40, wherein the boundary shelter 1 holds the top frame 30, the bottom frame 40 and the support posts 50 together. To gradually increase the distance between the top frame 30 and the bottom frame 40 by rotating the support posts 50 evenly tenses the boundary shelter 1 can firmly hold the head sleeves 312 and the top ends of the frame posts 51 together and form the play yard.

As shown in FIGS. 1, 2 and 4, to disassemble the play yard, simply unscrew the threaded adjustment shanks 531 from the holding bases 41 and pull out all the support posts 50. Then, the top frame 30 and the bottom frame 40 can be collapsed to reduce its size for travel and storage, as shown in FIG. 4. The collapse play yard can further be stored inside a storage pouch 60 which has two bags 61 attached thereon for storing the four support posts 50 respectively.

In view of the above description, the supporting structure for play yard can achieve the following remarkable features:

The supporting structure of the present invention can provide an absolutely safe play yard structure for the babies but still can be quickly collapsed to reduce its size when it is not used to save the travel or storage space. Conventional foldable design has been avoided to prevent unreasonable and unnecessary injury to the babies.

The present invention provides a supporting structure for play yard that is easy to set up and collapse within a relatively short time. Moreover, it has a more simple structure and a more economic cost in comparison with the conventional foldable play yard.

The supporting structure for play yard of the present invention can further be strengthened by adjusting the distance between top frame 30 and bottom frame 40 so as to tense the boundary shelter 1, so that it not only can provide a rigid frame structure free of shaking and rocking, but also can tensely support the boundary shelter to have a better appearance and to reinforce the rigid frame structure to avoid any unwanted collapse.

What is claimed is:

1. A supporting structure adapted to construct with a boundary shelter to form a play yard, comprising:

a ring-shaped top frame which comprises at least three head joints and three top construction posts, each of said head joints comprising two connecting ends and a tubular head sleeve integrally connecting between said two connecting ends and having a bottom opening, wherein each of said top construction posts is connected between two of said head joints by respectively connecting two ends of each of said top construction posts to said respective connecting ends of said respective two head joints;

a ring-shaped bottom frame which comprises at least three holding joints and three bottom construction posts, each of said holding joints having an axial threaded adjusting hole and two connector ends integrally and oppositely extended therefrom, wherein each of said bottom construction posts is connected between two of said holding joints by respectively connecting two ends of said bottom construction post to said respective connector ends of said two holding joints; and at least three identical support posts mounted between said top frame and said bottom frame to define an interior cavity, each of said support posts comprising a tubular frame post having a predetermined length, and an adjustment base axially affixed to a bottom end of said frame post, wherein said bottom end is axially inserted into said adjustment base and secured by rivets and each of said adjustment bases has a threaded upper shank and a base turner adapted for steadily sitting on ground to support said supporting structure and facilitating the rotation of said support post, wherein each of said threaded upper shanks has an outer diameter equal to an inner diameter of said threaded adjusting hole of each of said holding joints, wherein said support posts are respectively penetrated through said threaded adjusting holes of said respective holding joints until top ends of said frame posts of said support posts rotatably insert into said head sleeves through said bottom openings thereof respectively, and then by rotating each of said base turners, said threaded upper shanks of said support posts are respectively rotated and screwed in said threaded adjusting holes of said holding joints, so as to adjust a distance between said top frame and said bottom frame for tensing said boundary shelter which is mounted between said top frame and said bottom frame to form said play yard.

2. A supporting structure for play yard, as recited in claim 1, further comprising a top cap which is plugged at said top end of said frame post, wherein said top cap is adapted to reduce friction between said top end of said frame post and said head sleeve so as to enable said top end of said frame post smoothly rotating in said head sleeve.

3. A supporting structure for play yard, as recited in claim 1, wherein there are four head joints and four top construction posts having equal length to construct said top frame in circular ring shaped structure.

4. A supporting structure for play yard, as recited in claim 2, wherein there are four head joints and four top construction posts having equal length to construct said top frame in circular ring shaped structure.

5. A supporting structure for play yard, as recited in claim 4, wherein said four top construction posts are integrally connected with said four head joints by rivets respectively.

6. A supporting structure for play yard, as recited in claim 3, wherein there are four holding joints and four bottom construction posts having equal length to construct said bottom frame in circular ring shaped structure.

7. A supporting structure for play yard, as recited in claim 4, wherein there are four holding joints and four bottom construction posts having equal length to construct said bottom frame in circular ring shaped structure.

8. A supporting structure for play yard, as recited in claim 5, wherein there are four holding joints and four bottom construction posts having equal length to construct said bottom frame in circular ring shaped structure.

9. A supporting structure for play yard, as recited in claim 6, wherein said bottom construction posts are integrally connected with said four holding joints by rivets respectively.

10. A supporting structure for play yard, as recited in claim 7, wherein said bottom construction posts are integrally connected with said four holding joints by rivets respectively.

11. A supporting structure for play yard, as recited in claim 8, wherein said bottom construction posts are integrally connected with said four holding joints by rivets respectively.

12. A supporting structure for play yard, as recited in claim 6, wherein there are totally four support posts to construct with said top frame and said bottom frame.

13. A supporting structure for play yard, as recited in claim 7, wherein there are totally four support posts to construct with said top frame and said bottom frame.

14. A supporting structure for play yard, as recited in claim 8, wherein there are totally four support posts to construct with said top frame and said bottom frame.

15. A supporting structure for play yard, as recited in claim 9, wherein there are totally four support posts to construct with said top frame and said bottom frame.

16. A supporting structure for play yard, as recited in claim 10, wherein there are totally four support posts to construct with said top frame and said bottom frame.

* * * * *